US006282453B1

(12) United States Patent
Lombardi

(10) Patent No.: US 6,282,453 B1
(45) Date of Patent: Aug. 28, 2001

(54) METHOD FOR CONTROLLING A WORK IMPLEMENT TO PREVENT INTERFERENCE WITH A WORK MACHINE

(75) Inventor: Frank J. Lombardi, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/204,649

(22) Filed: Dec. 2, 1998

(51) Int. Cl.[7] ..... G05B 19/18
(52) U.S. Cl. ..... 700/63; 701/50
(58) Field of Search ..... 701/50; 700/62, 700/63, 56; 172/812

(56) References Cited

U.S. PATENT DOCUMENTS

| | | | | |
|---|---|---|---|---|
| 4,755,905 | * | 7/1988 | Telecky, Jr. | 361/236 |
| 5,088,020 | | 2/1992 | Nishida et al. | 700/40 |
| 5,160,239 | * | 11/1992 | Allen et al. | 414/699 |
| 5,333,533 | * | 8/1994 | Hosseini | 91/361 |
| 5,490,081 | * | 2/1996 | Kuromoto et al. | 700/178 |
| 5,701,793 | * | 12/1997 | Gardner et al. | 91/361 |
| 5,737,993 | * | 4/1998 | Cobo et al. | 91/361 |
| 5,899,008 | * | 5/1999 | Cobo et al. | 37/348 |
| 6,047,228 | * | 4/2000 | Stone et al. | 701/50 |
| 6,129,155 | * | 10/2000 | Lombardi | 172/2 |
| 6,185,493 | * | 2/2001 | Skinner et al. | 701/50 |

* cited by examiner

*Primary Examiner*—William Grant
*Assistant Examiner*—Edward F. Gain, Jr.
(74) *Attorney, Agent, or Firm*—Steve D. Lundquist

(57) ABSTRACT

A method for controllably moving a work implement attached to a work machine. The method includes the steps of inputting a velocity command, determining a plurality of desired cylinder positions as a function of the desired velocity command, and comparing the desired cylinder positions to allowable cylinder positions. The allowable cylinder positions are a function of a combination of the plurality of desired cylinder positions. The method also includes the steps of moving the work implement to a desired work implement position as a function of the desired cylinder positions, and stopping the movement of the work implement in response to at least one desired cylinder position being at a limit defined by a corresponding at least one allowable cylinder position.

9 Claims, 13 Drawing Sheets

METHOD FOR CONTROLLING A WORK IMPLEMENT TO PREVENT INTERFERENCE WITH A WORK MACHINE

TECHNICAL FIELD

This invention relates generally to a method for controlling a work implement on a work machine and, more particularly, to a method for determining a desired movement of a work implement and responsively controlling the work implement to prevent interference with the work machine.

BACKGROUND ART

Work machines, such as earthworking machines, are used extensively to perform many tasks. For example, earthworking machines, e.g., bulldozers, excavators, loaders, graders, and the like, are used to cut, move, and shape the earth to desired finished states. The work machines accomplish these tasks by the use of work implements. Examples of work implements for earthworking machines include blades and buckets.

Often, these work implements are controlled by linkages and assemblies which provide several degrees of freedom of motion. The multiple degrees of motion enhance the efficiency and versatility of the work that the machines are capable of producing. In the example of earthworking machines, the linkages and assemblies are hydraulically controlled to increase the output power available by the work implement.

As an example, a typical hydraulically powered excavator has four degrees of freedom; rotation of the excavator body, pivoting motion of a boom, pivoting motion of a stick, and pivoting motion of a bucket. These four degrees of freedom allow the excavator to move efficiently throughout the work area.

The multiple degrees of freedom of motion of the work implement, however, increase the complexity of control that an operator must maintain over the movement of the work implement. In the example of the excavator, an operator must control the rotation of the excavator body, the movement of the boom, the movement of the stick, and the movement of the bucket, sometimes all at once. In work machines having more than four degrees of freedom, the complexity of maintaining control over the movement of the work implement is greatly increased.

The increased complexity of controlling the motion of a work implement having multiple degrees of freedom also increases the probability of moving the implement in a manner that might bring the implement into undesired contact with some portion of the machine; that is, the implement may be brought into interference with the body, frame, tracks, wheels, or some other portion of the machine in an undesirable manner.

Track-type tractors, having dozer blades as work implements, are used to cut and push earth to achieve a desired contour or depth of cut. Typically, the blade on a track-type tractor will have up to four degrees of freedom of motion. However, the mounting configuration of a track-type tractor blade will normally only allow up to three degrees of freedom for a particular work machine. For example, the four degrees of freedom for a dozer blade would be lift (change in elevation of the blade), tilt (change in elevation of one end of the blade), pitch (change in cutting angle of the blade with the earth), and angle (change in the forward extension of one of the two ends of the blade with respect to the other end). A track-type tractor will be designed to allow three of the above degrees of freedom to allow the machine to perform a particular type of work. For example, a track-type tractor designed to push material may be capable of lift, tilt, and angle; but to change the pitch of the blade would require physically changing the mounting linkages of the blade to a different desired pitch. A different track-type tractor may be designed to cut material. This tractor would have lift, tilt, and pitch control; but would not be capable of changing the angle of the blade.

An exemplary track-type tractor blade having all four degrees of freedom of motion is described in detail below. This blade configuration allows simultaneous control of lift, tilt, pitch, and angle, making this blade suitable for both cutting and pushing applications. However, due to the complex interactions of the hydraulic cylinders which control the blade, each of which is independently controlled yet kinematically coupled to each other, this blade control configuration would be nearly impossible for an operator to control, in particular when moving the blade in close proximity to the body, frame, or tracks of the track-type tractor. The present invention is ideally suited to control a work implement such as the exemplary track-type tractor blade discussed below to prevent undesired interference with other portions of the track-type tractor.

The present invention is directed to overcoming one or more of the problems as set forth above.

DISCLOSURE OF THE INVENTION

In one aspect of the present invention a method for controllably moving a work implement attached to a work machine is shown. The method includes the steps of inputting a velocity command, determining a plurality of desired cylinder positions as a function of the desired velocity command, and comparing the desired cylinder positions to allowable cylinder positions. The allowable cylinder positions are a function of a combination of the plurality of desired cylinder positions. The method also includes the steps of moving the work implement to a desired work implement position as a function of the desired cylinder positions, and stopping the movement of the work implement in response to at least one desired cylinder position being at a limit defined by a corresponding at least one allowable cylinder position.

In another aspect of the present invention a method for controllably moving a work implement attached to a work machine is shown. The method includes the steps of inputting a velocity command in a work implement frame of reference, transforming the velocity command from the work implement frame of reference to a resolver frame of reference, responsively generating a plurality of desired resolver velocities, and comparing the desired resolver velocities to allowable resolver velocities. The allowable resolver velocities are a function of a combination of the plurality of desired resolver velocities. The method also includes the steps of determining desired resolver positions from the desired resolver velocities, determining desired cylinder positions as a function of the desired resolver positions, moving the work implement as a function of the desired cylinder positions, and stopping the movement of the work implement in response to at least one desired resolver velocity being at a limit of a corresponding at least one allowable resolver velocity.

In yet another aspect of the present invention a method for controllably moving a work implement attached to a work machine is shown. The method includes the steps of inputting a velocity command in a work implement frame of reference, transforming the velocity command from the work implement frame of reference to a cylinder frame of reference, responsively generating a plurality of desired cylinder velocities, and comparing the desired cylinder velocities to allowable cylinder velocities. The allowable cylinder velocities are a function of a combination of the plurality of desired cylinder velocities. The method also includes the steps of determining desired cylinder positions from the desired cylinder velocities, moving the work implement as a function of the desired cylinder positions, and stopping the movement of the work implement in response to at least one desired cylinder velocity being at a limit of a corresponding at least one allowable cylinder velocity.

BEST MODE FOR CARRYING OUT THE INVENTION

Figure 1:
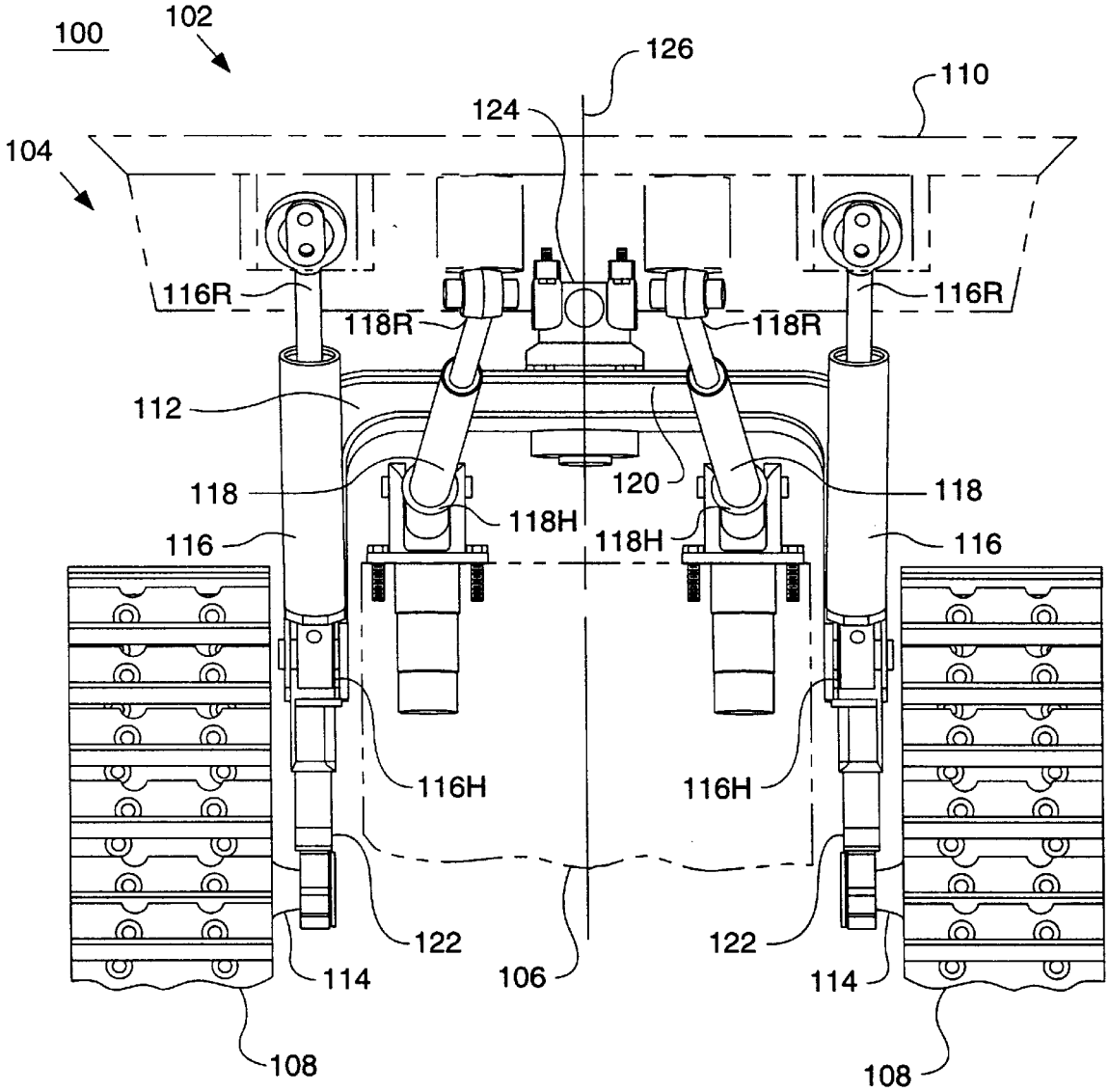
FIG. 1 is a diagrammatic illustration of a preferred embodiment of an exemplary earthworking implement as viewed from above, suitable for use with the present invention.
Figure 2:
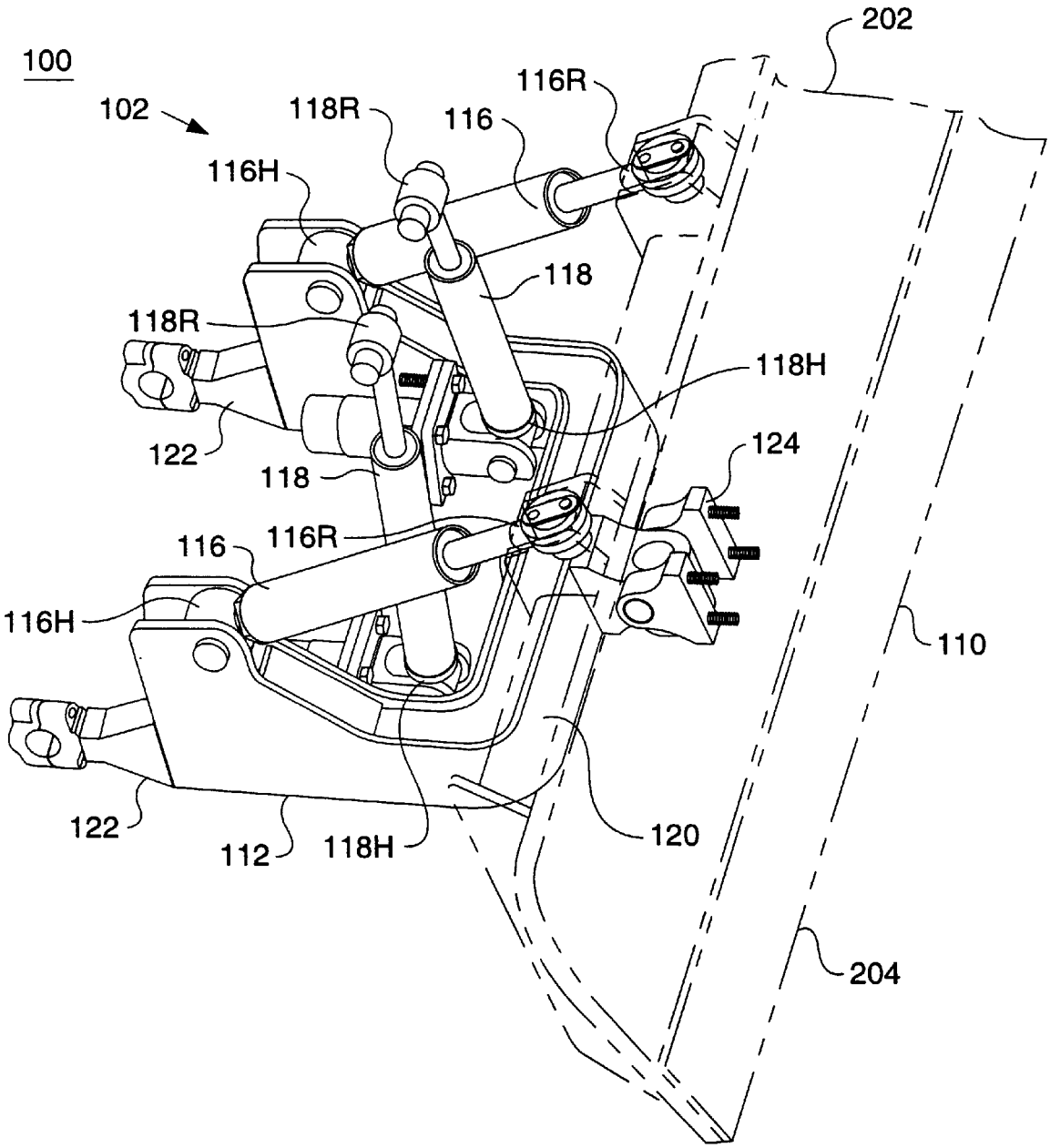
FIG. 2 is a diagrammatic illustration of a preferred embodiment of the exemplary earthworking implement of FIG. 1 as viewed from a second perspective.
Figure 3:
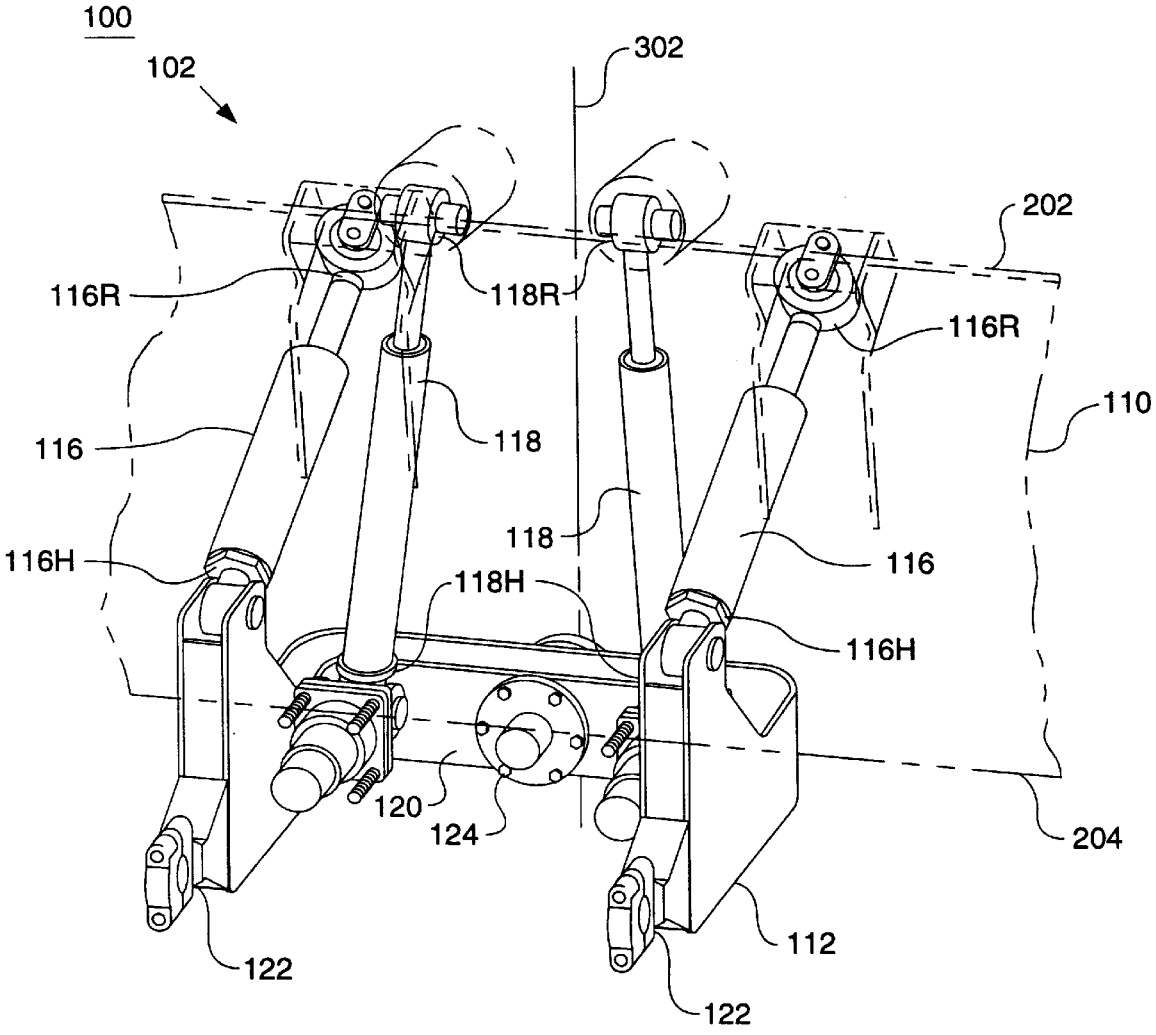
FIG. 3 is a diagrammatic illustration of a preferred embodiment of the exemplary earthworking implement of FIG. 1 as viewed from a third perspective.
Figure 4:
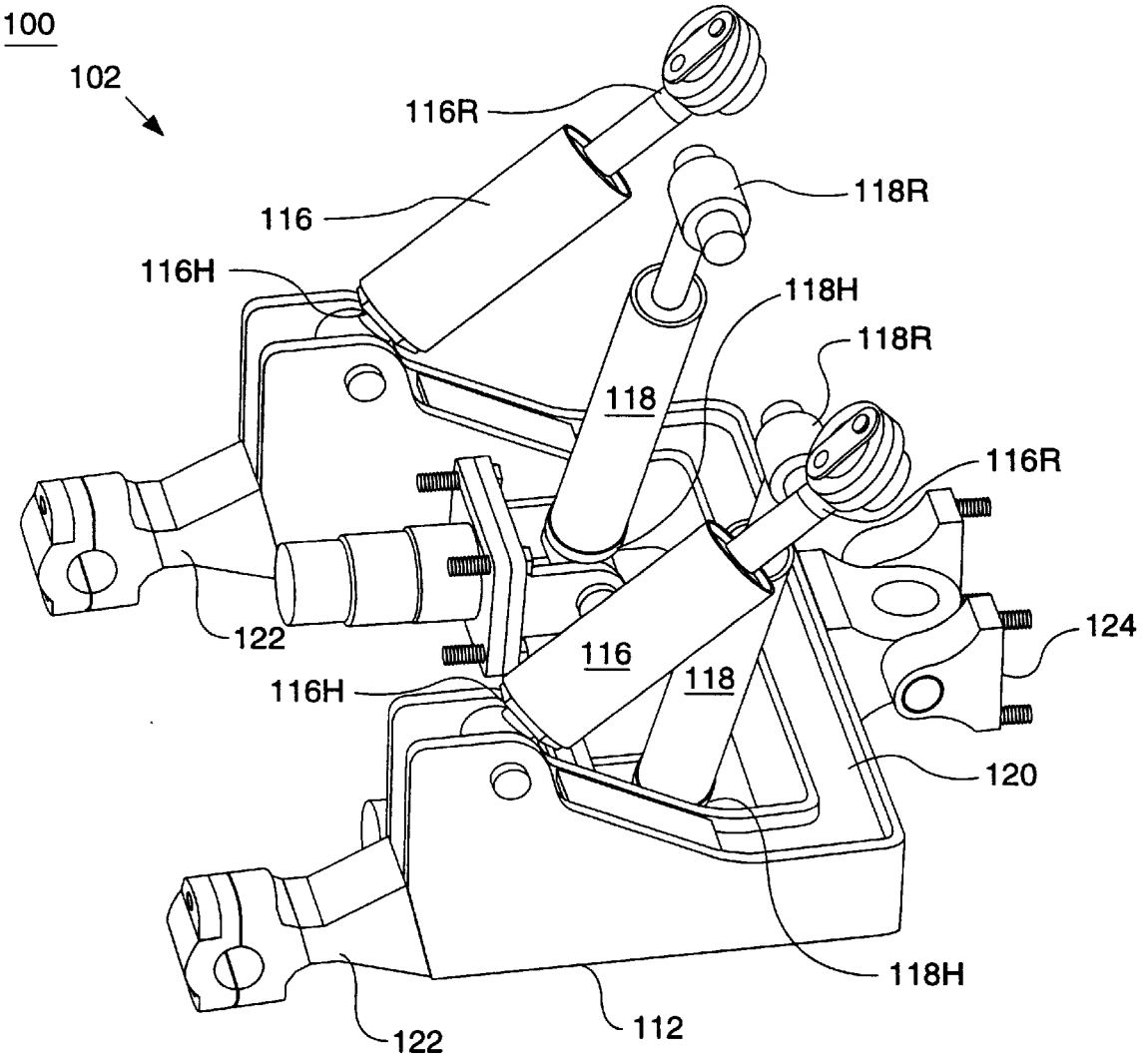
FIG. 4 is a diagrammatic illustration of a preferred embodiment of the exemplary earthworking implement of FIG. 1 as viewed from a fourth perspective.

The present invention is a method for controlling a work implement to prevent interference with a work machine. For purposes of describing the operation of the present invention more clearly, an exemplary earthworking implement and control system ideally suited for use with the present invention is discussed in detail below. The earthworking implement described below is a hydraulically controlled blade for a track-type tractor. It is to be understood, however, that the present invention is well suited for use with a variety of earthworking implements on a variety of earthworking machines. Examples of earthworking machines suitable for use with the present invention include, but are not limited to, loaders, excavators, graders, and the like.

Referring to the drawings, and in particular, referring to FIGS. 1–4, various views diagrammatically illustrating a preferred embodiment of an exemplary earthworking implement 102 are shown. The earthworking implement 102 is movably attached to a track-type tractor 104 having a main frame 106 and a track roller frame 108. The track roller frame 108 is located on a left and a right side of the main frame 106 of the track-type tractor 104.

Figure 5:
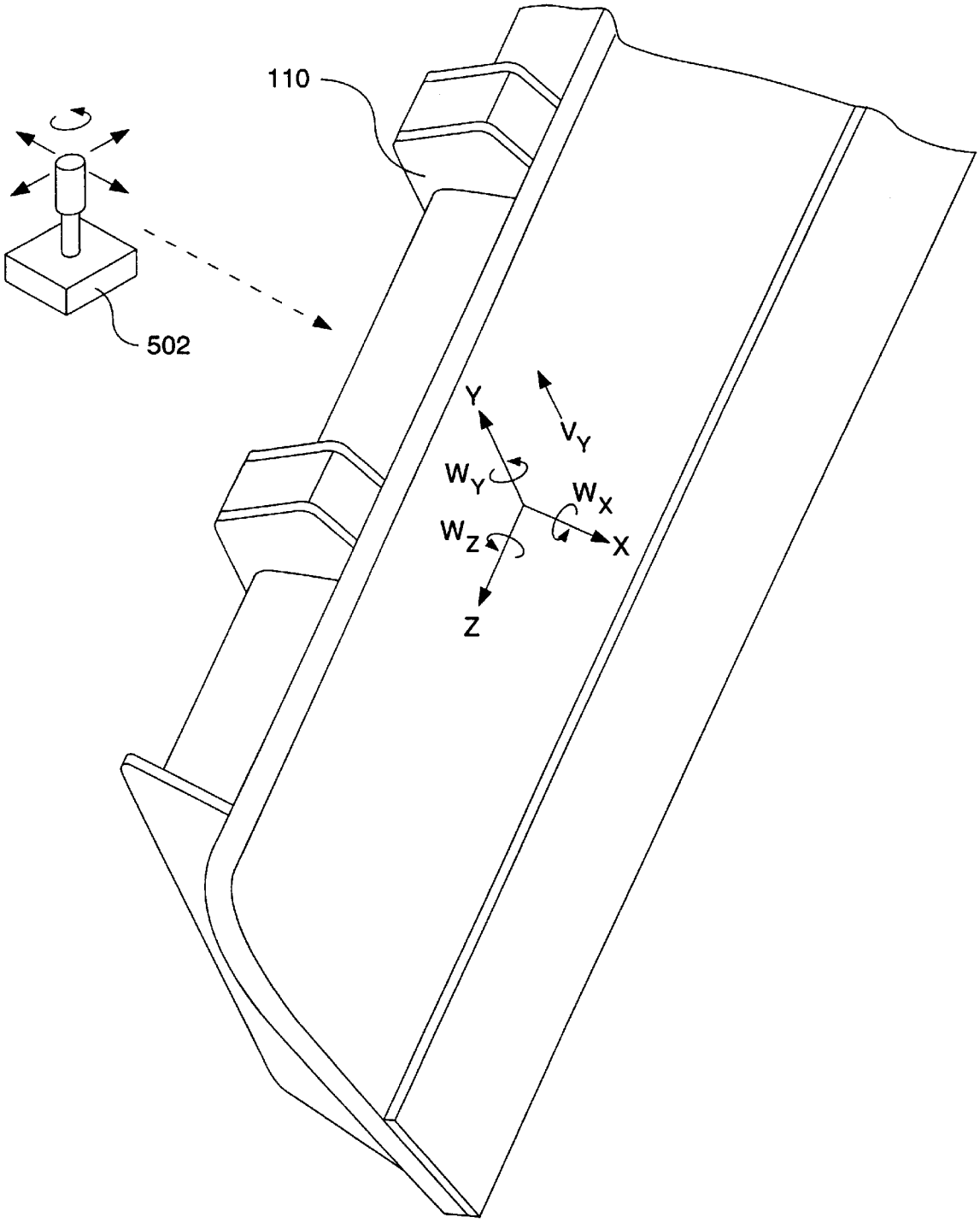
FIG. 5 is a diagrammatic illustration of a coordinate system depicting four degrees of freedom of a bulldozer blade.

Referring briefly to FIG. 5, a diagrammatic illustration of an earthworking implement 102 with respect to a coordinate system is shown. The earthworking implement 102 shown is a blade 110 of a track-type tractor 104. Preferably, the coordinate system is a Cartesian coordinate system. The blade 110 is adapted to move about four degrees of freedom, defined by the coordinate system, in free space, as $v_Y$ (lift), $w_X$ (tilt), $w_Y$ (angle), and $w_Z$ (pitch). In the preferred embodiment, the movement of the blade 110 is controlled by movement of a joystick 502, also having four degrees of freedom corresponding to the four degrees of freedom of the blade 110.

With continued reference to FIGS. 1–4, in the preferred embodiment, a c-frame 112 is pivotally attached to inner portions of the track roller frame 108 at positions toward a forward portion of the track-type tractor 104, depicted in FIG. 1 as c-frame to track roller frame attachments 114. The c-frame 112 has a front portion 120 having two ends. Each end curves in a substantially perpendicular direction from the front portion 120 into arm portions 122. Each arm portion 122 is attached to the track roller frame 108 at ends of the arm portions 122 away from the front portion 120. The c-frame 112 is configured such that the front portion 120 raises and lowers when the arm portions 122 pivot with respect to the track roller frame 108.

In previous track-type tractor configurations using a c-frame, the c-frame is either mounted to the outside of the track roller frame, or to the main frame. The configuration of the present invention, i.e., mounting the c-frame 112 to the inside of the track roller frame 108, provides protection of the linkage joints not available when the c-frame is mounted to the outside of the track roller frame, and provides greater stability than when the c-frame is mounted to the main frame.

Preferably, four independently operable hydraulic cylinders 116,118 are pivotally attached to one of the main frame 106 and the c-frame 112. The cylinders 116,118 are kinematically coupled to each other, i.e., motion of one affects multiple degrees of motion of the implement 102, yet they are controlled independently. Each of the hydraulic cylinders 116,118 has a head end 116H,118H which is located toward the attachment to one of the main frame 106 and the c-frame 112. In addition, each of the hydraulic cylinders 116,118 has a rod end 116R,118R which is located at the other end of the cylinders 116,118 in a direction substantially vertically upwards of the head ends 116H,118H. By mounting the hydraulic cylinders 116,118 with the rod ends 116R,118R directed upwards, the cylinders 116,118 are in effect pushing the earthworking implement 102 upwards when lifting. Conventional cylinder configurations, i.e., with the head ends directed upwards, are pulling the earthworking implement up when lifting. The advantage of configuring the cylinders with the rod ends up is that the lift capacity of the cylinders is increased by the action of pushing, rather than pulling the load.

The rod ends 116R,118R of the hydraulic cylinders 116, 118 are attached to an upper portion 202 of the blade 110. A lower portion 204 of the blade 110 is pivotally attached to the c-frame 112 at a location on the c-frame 112 near the center of the front portion 120, depicted in FIGS. 1–4 as a blade to c-frame attachment 124. In one embodiment, the blade 110 is attached to the c-frame 112 by means of a ball joint. In another embodiment, the blade 110 is attached to the c-frame 112 by means of a two pin universal joint. It is understood that other means for pivotally attaching the blade 110 to the c-frame 112 could be used so that the blade 110 may be pivoted in all directions relative to the c-frame 112.

In the preferred embodiment, the rod ends 116R,118R of the hydraulic cylinders 116,118 are trunnion mounted to the blade 110. Additionally, the head ends 116H,118H of the hydraulic cylinders 116,118 are trunnion mounted to one of the main frame 106 and the c-frame 112. However, other methods for providing pivotal connections of the cylinders 116,118 could be used.

Two of the four hydraulic cylinders 118 are located generally in line and parallel with the arm portions 122 of the c-frame 112. These two cylinders 116 are pitch and angle cylinders 118, and are used generally to control the pitch and angle of the blade 110. The head ends 118H of the pitch and angle cylinders 118 are attached to the arm portions 122 of the c-frame 112.

The other two of the four hydraulic cylinders 116 are located inward of the pitch and angle cylinders 118 relative to the center portion of the c-frame 112. These two cylinders 116 are lift and tilt cylinders 118 and are used generally to control the lift and tilt of the blade 110. The head ends 116H of the lift and tilt cylinders 118 are attached to the main frame 106 at substantially similar distances from a longitudinal axis 126 along the center of the track-type tractor 104.

Preferably, the rod ends 116R of the lift and tilt cylinders 116 are attached to the upper portion 202 of the blade 110 at substantially similar distances from a centerline 302 extending vertically through the center of the blade 110. In addition, the distance of the head ends 116H of the lift and tilt cylinders 116 from the longitudinal axis 126 is preferably greater than the distance of the rod ends 116R of the lift and tilt cylinders 116 from the centerline 302 to provide greater stability.

Figure 6:
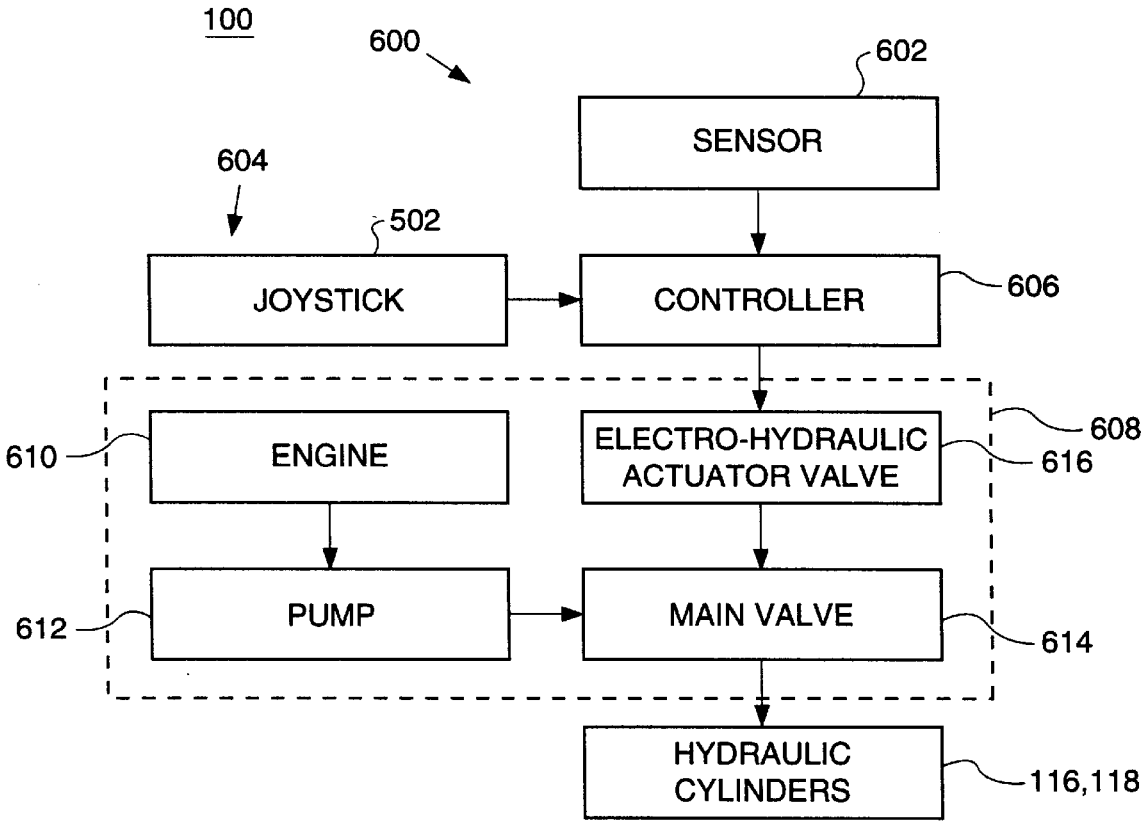
FIG. 6 is a block diagram illustrating a preferred embodiment of a control system adapted to control an earthworking implement.

Referring now to FIG. 6, a block diagram illustrating a preferred embodiment of a computer-based apparatus 100 for controlling a plurality of hydraulic cylinders 116,118 to control the movement of a work implement 102 having multiple degrees of freedom is shown. The work implement 102 is described with respect to the present invention as an earthworking implement 102, such as a blade or a bucket. As described above, the hydraulic cylinders 116,118 are pivotally attached to the earthworking implement 102, and the earthworking implement 102 and the hydraulic cylinders 116,118 are pivotally attached to a work machine 600. The work machine 600 may be a track-type tractor, excavator, motor grader, or other type of work machine.

Figure 7:
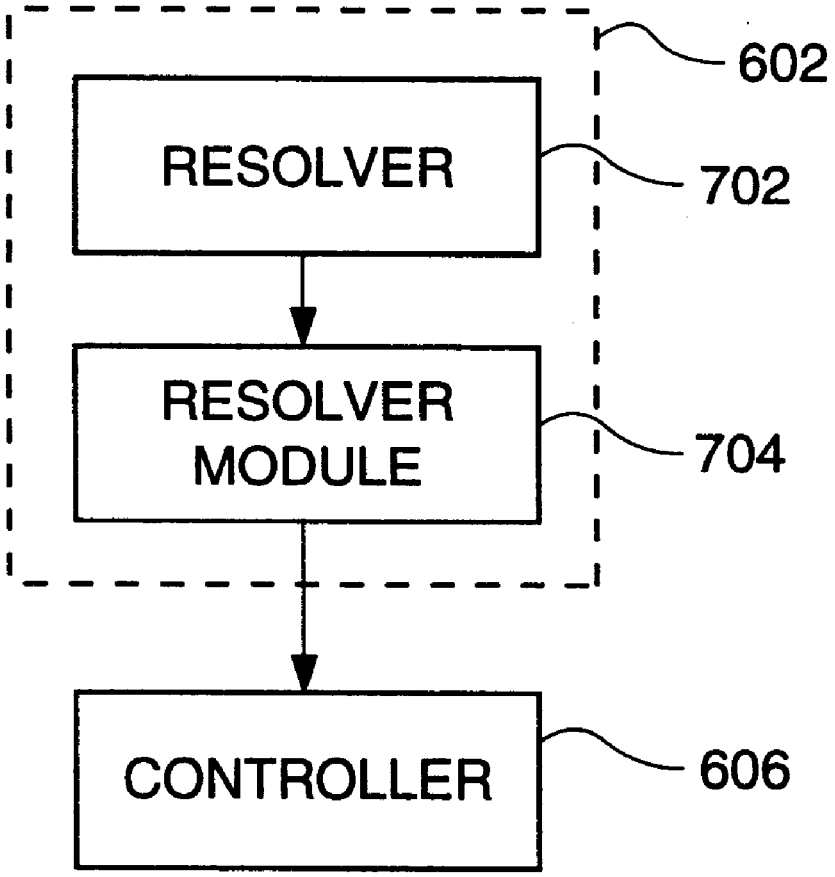
FIG. 7 is a block diagram illustrating an embodiment of a sensor for sensing a rotational motion of two portions of an earthworking implement.

At least one sensor 602 is attached to the work machine 600 and is adapted to sense the position of at least one of the work implement 102 and the hydraulic cylinders 116,118. In the preferred embodiment, as illustrated in FIG. 7, the sensor 602 is a resolver 702, adapted to sense rotary position of a linkage pin (not shown) connecting two linkages (also not shown) of an earthworking implement 102. For example, as is well known in the art, an earthworking implement on an excavator has a boom, stick, and bucket; each connected by linkage pins in a manner allowing each to pivot with respect to the other connecting portion. A similar example of pivoting linkages exists with respect to the track-type tractor blade 110 described in detail above.

Preferably, a resolver 702 is used for each linkage connection where it is desired to sense the rotary position of the linkages. When multiple resolvers 702 are used, it is preferred to deliver the resolver signals to a resolver module 704. In the preferred embodiment, the resolver module 704 is processor based, and is adapted to condition the signals for further processing, as is described below.

Alternatively, a cylinder position sensor (not shown) may be used to determine the position of at least one hydraulic cylinder 116,118, which in turn can be correlated to the rotary position of associated linkages. Cylinder position sensors are well known in the art and may be of such types as linear resolvers, RF sensors, infra-red sensors, and the like.

Combinations of rotary position and cylinder position sensors may be used, as desired.

With continued reference to FIG. 6, a means for generating a velocity command 604 is shown. Preferably, the means 604 is a joystick 502, controlled by an operator of the work machine 600. However, other means 604 may be employed, e.g., inputting commands on a keyboard. In the preferred embodiment, the velocity command is generated with respect to a work implement frame of reference, such as the Cartesian coordinate system discussed above with reference to FIG. 5. A velocity command is generally preferable over a position command since greater control over the motion of the earthworking implement 102 can be achieved by associating movement of the joystick 502 with the velocity of the implement 102 rather than the position of the implement 102.

A controller 606, preferably located on the work machine 600, is adapted to receive a signal from each sensor 602 and to receive a signal from the means for generating a velocity command 604, and responsively generate a work implement control signal. The work implement control signal is adapted to controllably move at least one hydraulic cylinder 116,118 to move the work implement 102 in an least one degree of freedom to a desired work implement position. The work implement control signal is also adapted to controllably move at least one other hydraulic cylinder 116,118 to maintain the position of the work implement 102 in at least one other degree of freedom.

In the configuration where the sensors 602 are resolvers 702, and the position signals from the resolvers 702 are delivered to a resolver module 704, the signals are conditioned by the resolver module 704 to be in condition for acceptance by the controller 606. The signals are then delivered to the controller 606 for processing as described above.

In the preferred embodiment, the work machine 600 includes a hydraulic control system 608 which is adapted to receive the work implement control signal and responsively control the movement of the work implement 102. The hydraulic control system 608 includes an engine 610 located on the work machine 600. The engine 610 provides power to operate the hydraulic control system 608. A hydraulic pump 612 is connected to and driven by the engine 610. The hydraulic pump 612 is adapted to pressurize a supply of hydraulic fluid. At least one main valve 614 is located on the work machine 600 and is adapted to receive the pressurized hydraulic fluid from the pump 612. The hydraulic control system 608 also includes at least one electro-hydraulic actuator valve 616 located on the work machine 600 and adapted to receive the work implement control signal from the controller 606 and responsively control activation of the main valve 614, the main valve 614 being adapted to responsively control the movement of at least one hydraulic cylinder 116,118. The operation of hydraulic control systems on work machines is well known in the art and need not be discussed in more detail.

Figure 8:
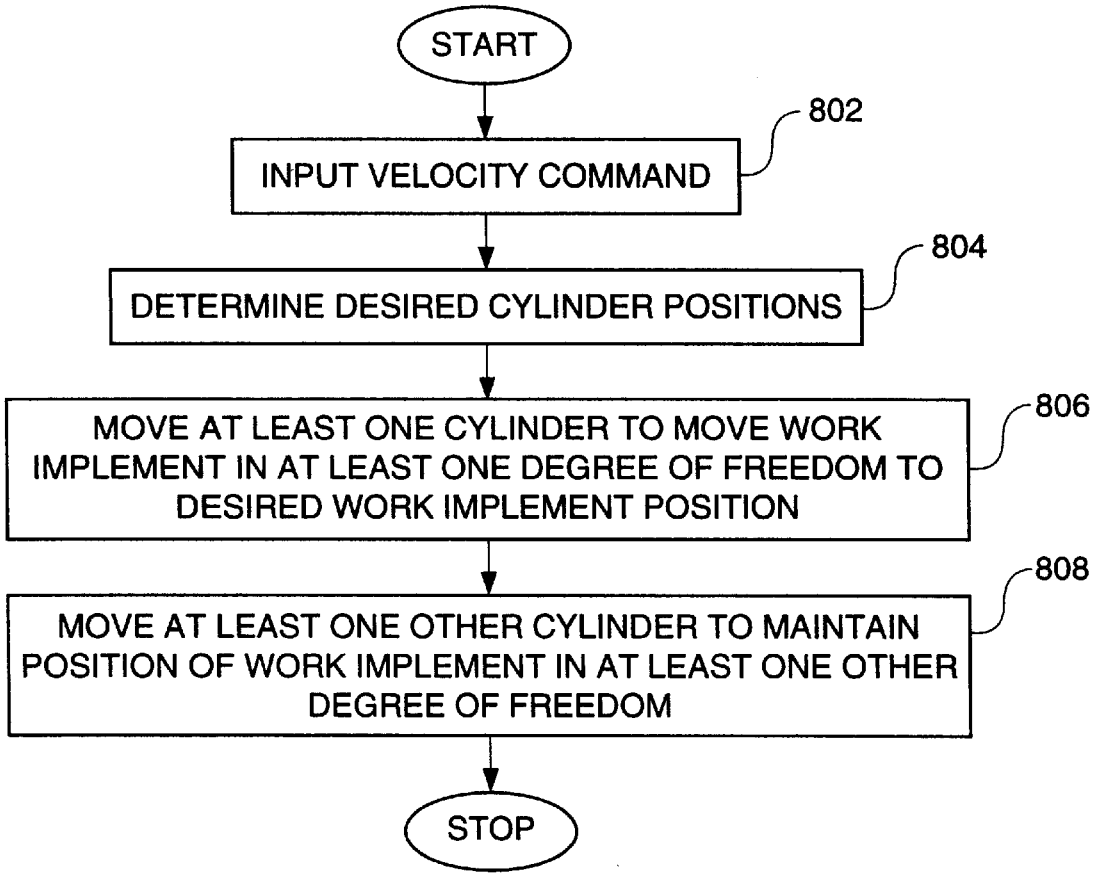
FIG. 8 is a flow diagram illustrating an aspect of a method for controlling an earthworking implement.
Figure 9:
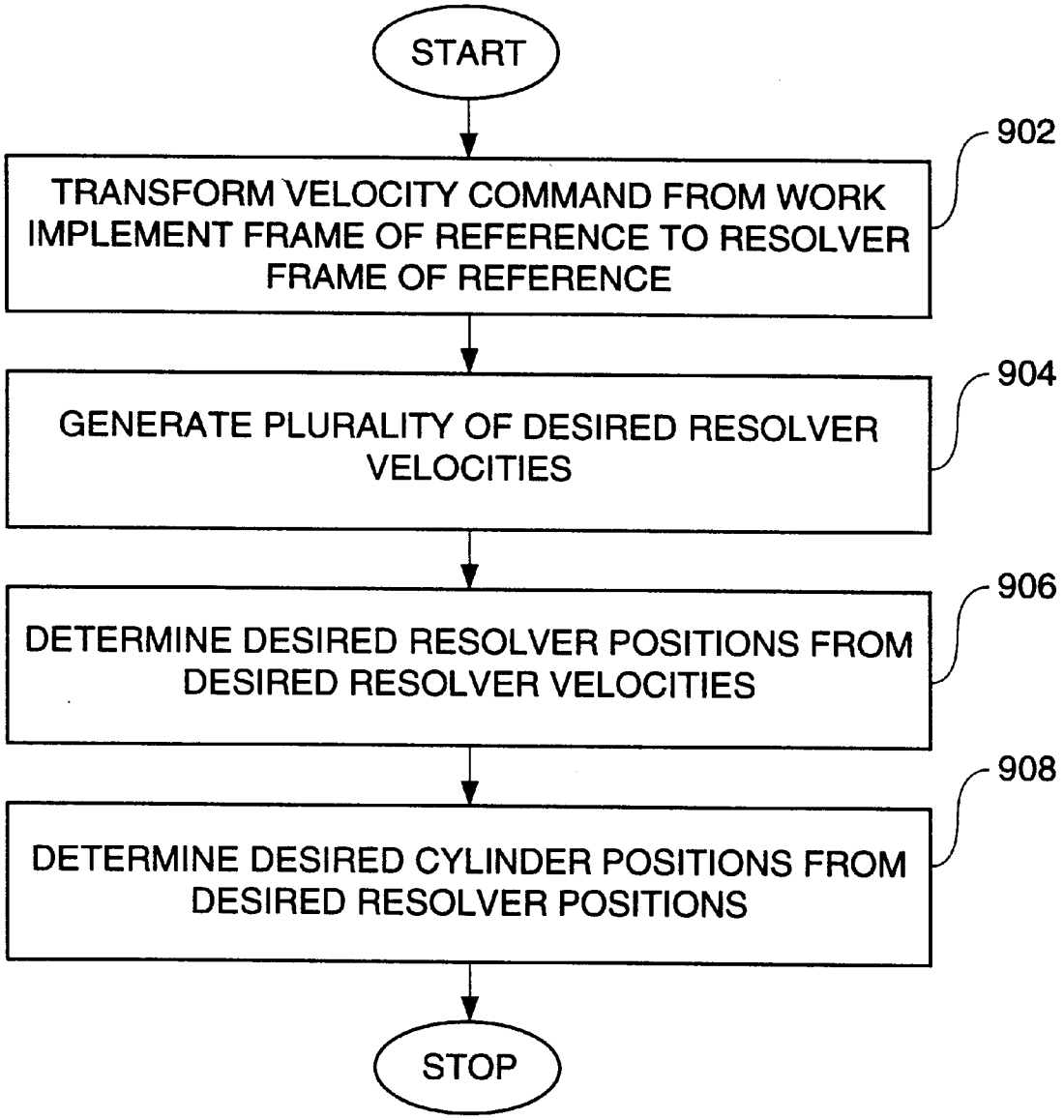
FIG. 9 is a flow diagram illustrating another aspect of a method for controlling an earthworking implement.
Figure 10:
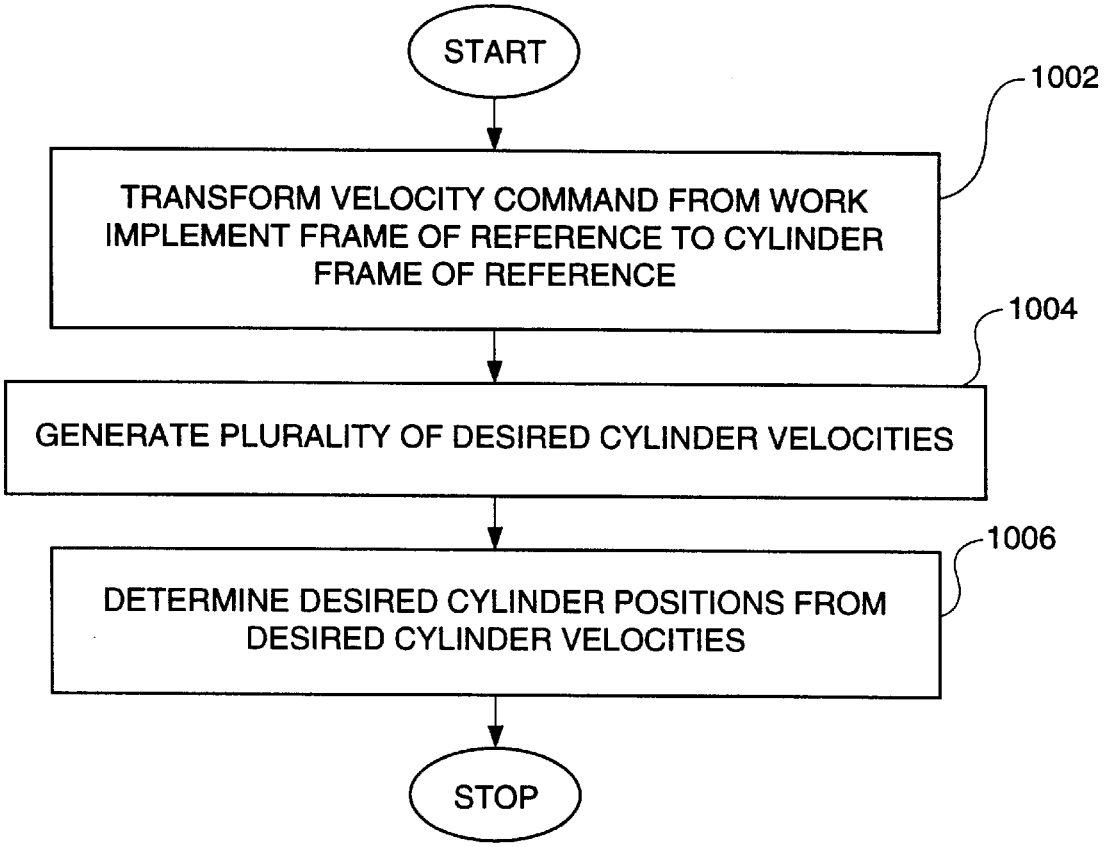
FIG. 10 is a flow diagram illustrating yet another aspect of a method for controlling an earthworking implement.

Referring now to FIGS. 8–10, a computer-based method for controlling a plurality of hydraulic cylinders 116,118 to control the movement of a work implement 102 having multiple degrees of freedom is shown. The method is described below with reference to the exemplary track-type tractor earthworking implement 102 described in detail above. However, the method would work equally well with other work machines capable of moving a work implement in multiple degrees of freedom.

In FIG. 8, in a first control block 802, a velocity command is input in a work frame of reference. In a second control block 804, the desired positions of each hydraulic cylinder 116,118 are determined as a function of the velocity command. The desired cylinder positions correspond to the desired position of the work implement 102.

In a third control block 806, at least one cylinder 116,118 is controllably moved to move the work implement 102 in at least one degree of freedom to the desired implement position. Concurrently, in a fourth control block 808, at least one other cylinder 116,118 is controllably moved to maintain the position of the work implement 102 in at least one other degree of freedom.

Referring to FIG. 9, a preferred embodiment of a method for determining the desired cylinder positions is shown.

In a first control block 902, the velocity command is transformed from the work implement frame of reference to a resolver frame of reference. Responsively, in a second control block 904, a plurality of desired resolver velocities is generated.

Using matrix notation, the transformation described above is depicted as Equation 1.

$$\begin{bmatrix} w_x \\ w_y \\ w_z \\ v_y \end{bmatrix} [T_{BF}^{RF}] = \begin{bmatrix} \dot{R}_1 \\ \dot{R}_2 \\ \dot{R}_3 \\ \dot{R}_4 \end{bmatrix} \quad \text{(Equation 1)}$$

where $w_x$, $w_y$, $w_z$, and $v_y$ are the degrees of freedom of the work implement 102, the T matrix is the transform matrix from blade reference (BF) to resolver reference (RF), and the $R_x$ matrix includes the resolver velocities corresponding to the four degrees of freedom of the work implement 102.

In a third control block 906, the desired resolver positions are determined from the desired resolver velocities, preferably be integration, as depicted in Equation 2.

$$\begin{bmatrix} \dot{R}_1 \\ \dot{R}_2 \\ \dot{R}_3 \\ \dot{R}_4 \end{bmatrix} \left[\frac{1}{s}\right] = \begin{bmatrix} R_1 \\ R_2 \\ R_3 \\ R_4 \end{bmatrix} \quad \text{(Equation 2)}$$

In a fourth control block 908, the desired positions of the hydraulic cylinders 116,118 are determined from the desired resolver positions, using a transform function, as shown in Equation 3.

$$\begin{bmatrix} R_1 \\ R_2 \\ R_3 \\ R_4 \end{bmatrix} [T_R^{cyl}] = \begin{bmatrix} C_1 \\ C_2 \\ C_3 \\ C_4 \end{bmatrix} \quad \text{(Equation 3)}$$

where the T matrix is a resolver position (R) to cylinder position (cyl) transform, and the C matrix includes the desired cylinder positions for four degrees of freedom of the work implement 102.

In an alternative embodiment, using cylinder position sensors rather than resolvers, the transform from the velocity command is made from a work implement frame of reference to a cylinder frame of reference, as is shown in FIG. 10 in a first control block 1002. In a second control block 1004, a plurality of desired cylinder velocities are generated in response to the transform, as shown in Equation 4.

$$\begin{bmatrix} w_x \\ w_y \\ w_z \\ v_y \end{bmatrix} [T_{BF}^{cyl}] = \begin{bmatrix} \dot{C}_1 \\ \dot{C}_2 \\ \dot{C}_3 \\ \dot{C}_4 \end{bmatrix} \quad \text{(Equation 4)}$$

Control then proceeds to a third control block 1006, where the desired cylinder positions are determined from the desired cylinder velocities, preferably by integration as is shown in Equation 5.

$$\begin{bmatrix} \dot{C}_1 \\ \dot{C}_2 \\ \dot{C}_3 \\ \dot{C}_4 \end{bmatrix} \left[\frac{1}{s}\right] = \begin{bmatrix} C_1 \\ C_2 \\ C_3 \\ C_4 \end{bmatrix} \quad \text{(Equation 5)}$$

Figure 11:
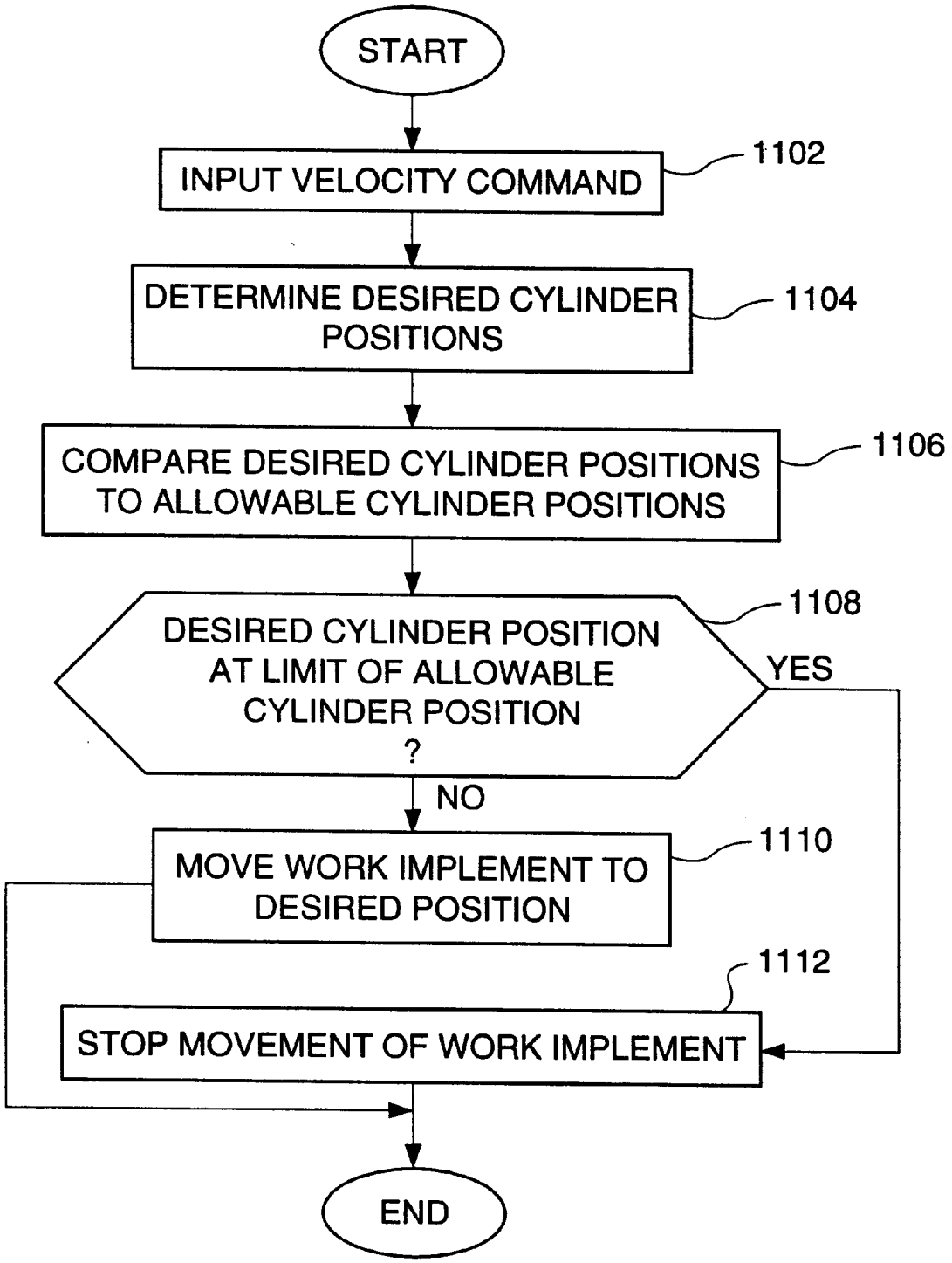
FIG. 11 is a flow diagram illustrating an aspect o f the present invention.

Referring now to FIG. 11, a preferred method for controllably moving a work implement 102 to prevent interference with a work machine 600 is shown. In a first control block 1102, a velocity command is input in a work implement frame of reference. In a second control block 1104, a plurality of desired cylinder positions are determined as a function of the velocity command. The desired cylinder positions correspond to a desired work implement position.

Control then proceeds to a third control block 1106, where the desired cylinder positions are compared to allowable cylinder positions. The allowable cylinder positions are a function of the combination of the plurality of desired cylinder positions. For example, an excavator has a boom cylinder, a stick cylinder, and a bucket cylinder, in addition to the swing position of the cab. The allowable boom cylinder position is a function of the combination of the positions of all cylinders. Therefore, an allowable boom cylinder position in one combination may not be allowable in another combination.

Preferably, the determination of allowable cylinder positions is performed by the controller 606 using a multi-dimensional look-up table.

In a first decision block 1108, it is determined if the desired cylinder position has reached a limit of allowable cylinder position. If a limit has not been reached, then control proceeds to a fourth control block 1110, where the work implement 102 is moved to the desired position. If a limit has been reached, then control proceeds from the first decision block 1108 to a fifth control block 1112, where the movement of the work implement 102 is stopped.

In the preferred embodiment, the control method to stop the work implement is achieved by modifying one of Equations 2 or 5, depending on which embodiment of implement control is used. The modifications result in Equations 6 and 7, shown below.

$$\begin{bmatrix} \dot{R}_1 \\ \dot{R}_2 \\ \dot{R}_3 \\ \dot{R}_4 \end{bmatrix} \left[\frac{k}{s}\right] = \begin{bmatrix} R_1 \\ R_2 \\ R_3 \\ R_4 \end{bmatrix} \quad \text{(Equation 6)}$$

$$\begin{bmatrix} \dot{C}_1 \\ \dot{C}_2 \\ \dot{C}_3 \\ \dot{C}_4 \end{bmatrix} \left[\frac{k}{s}\right] = \begin{bmatrix} C_1 \\ C_2 \\ C_3 \\ C_4 \end{bmatrix} \quad \text{(Equation 7)}$$

where k has replaced 1 in both equations. The variable k has a value of 0 or 1. If k is 1, then Equations 6 and 7 are equivalent to Equations 2 and 5; and the control system continues to move the work implement 102. However, if it is determined in the first decision block 1108 that a desired cylinder position has reached a limit of allowable cylinder position, then k is changed to a value of 0, thus causing the control algorithms to stop movement of the work implement 102. It is, however, preferred to change k from a value of 1 to a value of 0 incrementally, thus stopping the movement of the work implement 102 more gradually, and therefore more smoothly.

Figure 12:
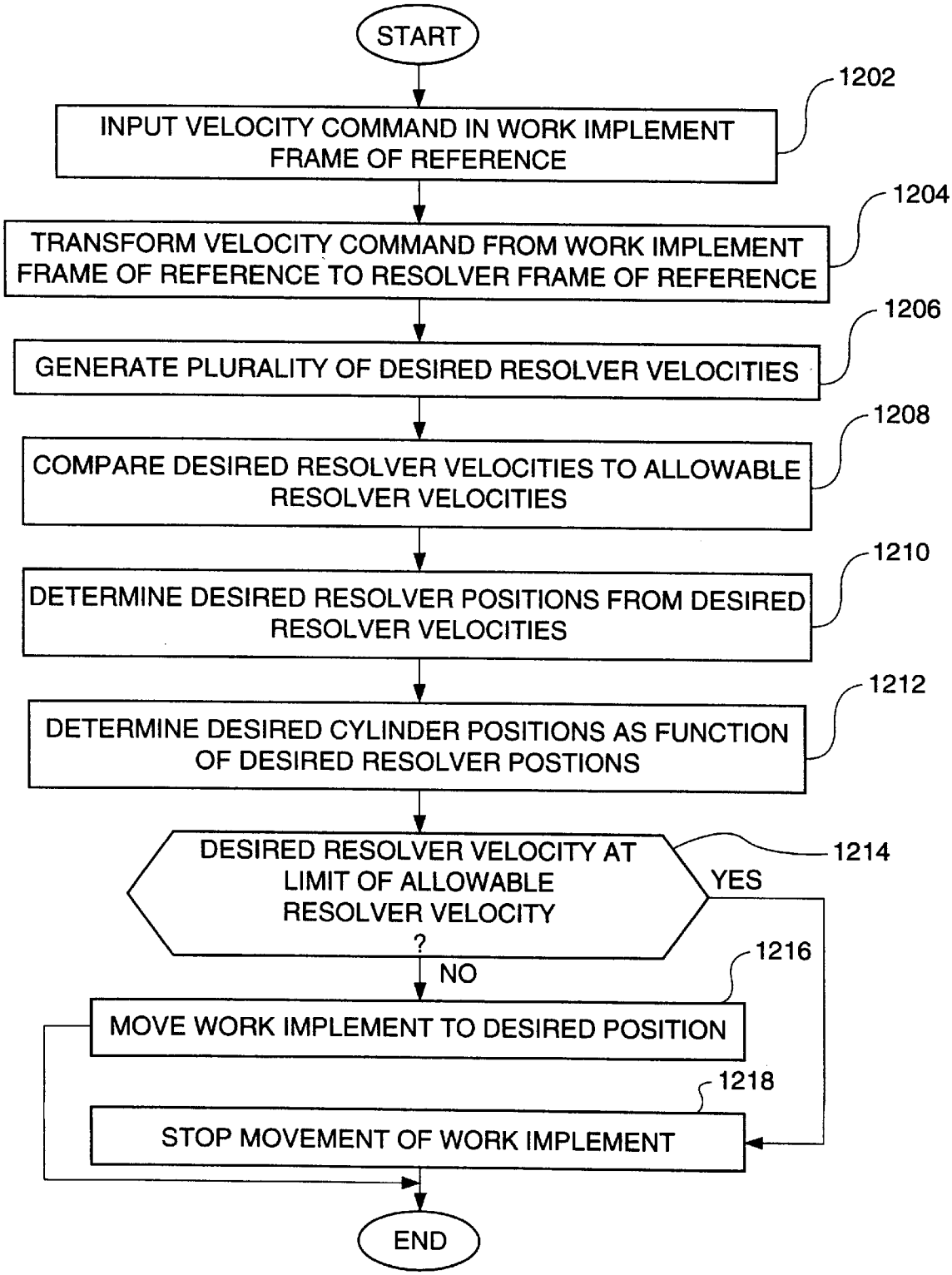
FIG. 12 is a flow diagram illustrating another aspect of the present invention.

Referring now to FIG. 12, an aspect of the present invention relative to an alternative control embodiment described above is shown. In a first control block 1202, a velocity command is input in a work frame of reference. In a second control block 1204, the velocity command is transformed from the work implement frame of reference to a resolver frame of reference. In a third control block 1206, a plurality of desired resolver velocities are generated as a function of the velocity command.

Control then proceeds to a fourth control block 1208, where the desired resolver velocities are compared to allowable resolver velocities. In a fifth control block 1210, a plurality of desired resolver positions are determined from the desired resolver velocities. In a sixth control block 1212, a plurality of desired cylinder positions are determined as a function of the desired resolver positions.

In a first decision block 1214, it is determined if each of the desired resolver velocities is at a limit of a corresponding allowable resolver velocity. If the desired resolver velocities are not at the limits, control proceeds to a seventh control block 1216, where the work implement 102 is moved to the desired position, based on the velocity command. If one of the desired resolver velocities is at a limit of an allowable resolver velocity, then control proceeds from the first decision block 1214 to an eighth control block 1218, where the movement of the work implement 102 is stopped.

Figure 13:
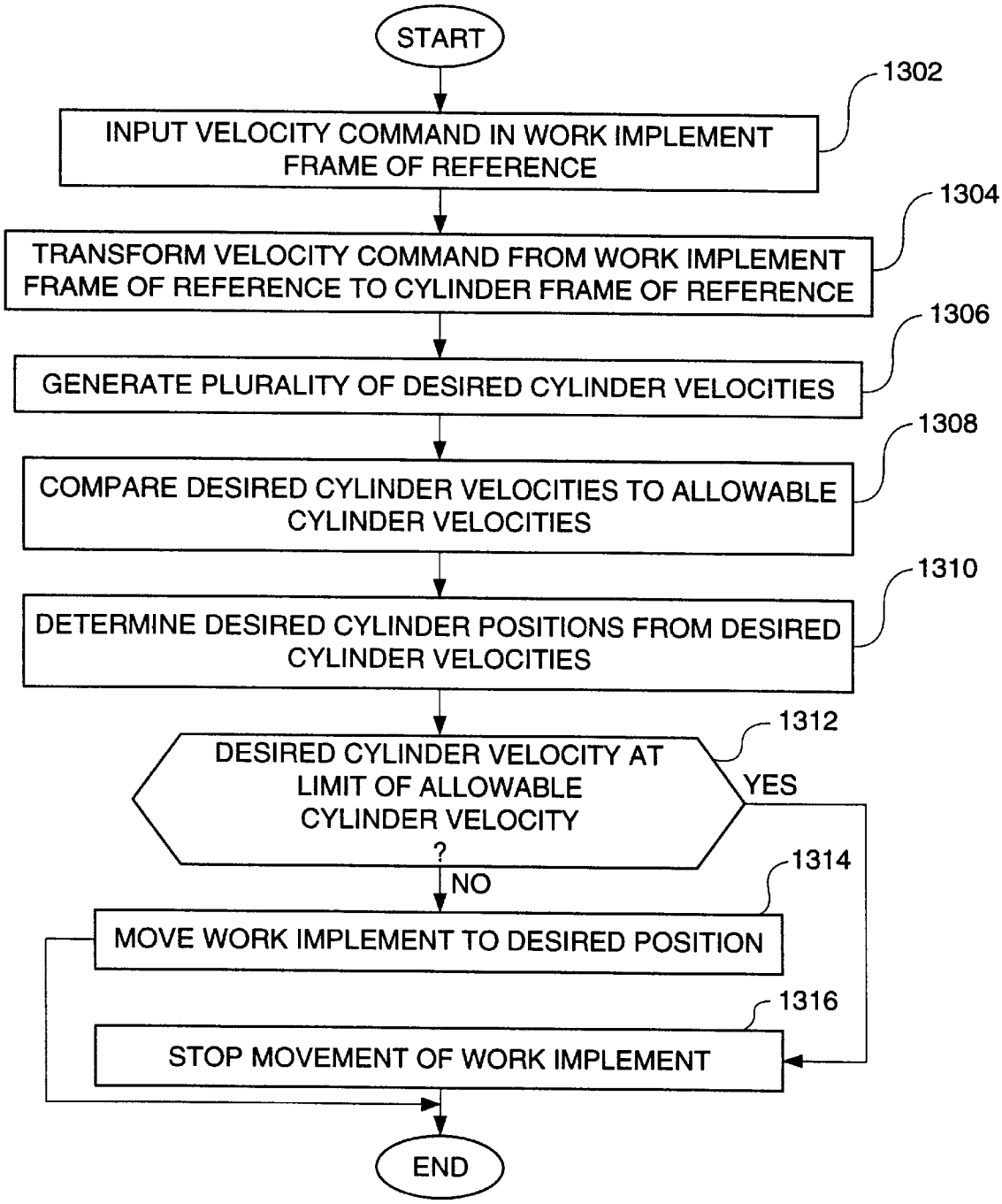
FIG. 13 is a flow diagram illustrating yet another aspect of the present invention.

Referring now to FIG. 13, another aspect of the present invention based on an alternative embodiment of a preferred control system is shown.

In a first control block 1302, the velocity command is input in a work implement frame of reference. In a second control block 1304, the velocity command is transformed from the work implement frame of reference to a cylinder frame of reference. In a third control block 1306, a plurality of desired cylinder velocities are generated. In a fourth control block 1308, the desired cylinder velocities are compared to a plurality of allowable cylinder velocities. In a fifth control block 1310, a plurality of desired cylinder positions are determined from the desired cylinder velocities.

In a first decision block 1312, it is determined if any desired cylinder velocity is at a limit of a corresponding allowable cylinder velocity. If no desired cylinder velocities are at the limit, then control proceeds to a sixth control block 1314, where the work implement 102 is moved to the desired position. If a desired cylinder velocity is at a limit, then control proceeds from the first decision block 1312 to a seventh control block 1316, where movement of the work implement 102 is stopped.

INDUSTRIAL APPLICABILITY

As an example of an application of the present invention, the exemplary earthworking implement 102 of the track-type tractor 104 discussed above has four degrees of freedom, accomplished by independently controlled, yet kinematically coupled hydraulic cylinders 116,118. The design of the earthworking implement 102 provides a great deal of freedom of movement. This advantage offers, however, a disadvantage. The blade 110 of the earthworking implement 102 may easily interfere with other portions of the track-type tractor 104, such as the body, frame, tracks, and even the cylinders 116,118. The complex interactions of the control of the cylinders 116,118 make it difficult, if not impossible, for an operator to reasonably prevent such interference from occurring.

The present invention, therefore, provides a control method which monitors the movement of the work implement 102 by monitoring each of the movable portions of the work implement 102, i.e., each cylinder 116,118 or each resolver 702, determines the overall movement of the work implement 102 based on a compilation and the interactions of the individual sensed motions, and prevents interference from occurring.

Other aspects, objects, and features of the present invention can be obtained from a study of the drawings, the disclosure, and the appended claims.

What is claimed is:

1. A method for controllably moving a work implement attached to a work machine, the work implement being controllably moved by a plurality of independently controlled, kinematically coupled hydraulic cylinders, including the steps of:

inputting a velocity command in a work implement frame of reference;

determining a plurality of desired cylinder positions as a function of the velocity command, the desired cylinder positions corresponding to a desired work implement position;

comparing the plurality of desired cylinder positions to allowable cylinder positions, each allowable cylinder position being an independent function of a combination of the plurality of desired cylinder positions;

controllably moving the work implement to the desired work implement position as a function of the desired cylinder positions; and controllably stopping the movement of the work implement in response to at least one desired cylinder position being at a limit defined by a corresponding at least one allowable cylinder position.

2. A method, as set forth in claim 1, wherein determining a plurality of desired cylinder positions includes the steps of:

transforming the velocity command from the work implement frame of reference to a resolver frame of reference and responsively generating a plurality of desired resolver velocities;

determining a plurality of desired resolver positions from the plurality of desired resolver velocities; and determining the plurality of desired cylinder positions from the plurality of desired resolver positions.

3. A method, as set forth in claim 2, wherein comparing the plurality of desired cylinder positions to allowable cylinder positions includes the steps of:

comparing the plurality of desired resolver velocities to allowable resolver velocities; and determining the allowable cylinder positions as a function of the allowable resolver velocities.

4. A method, as set forth in claim 1, wherein the velocity command is input by a joystick.

5. A method, as set forth in claim 1, wherein the work implement frame of reference is based on a Cartesian coordinate system in free space.

6. A method, as set forth in claim 1, wherein determining a plurality of desired cylinder positions includes the steps of:

transforming the velocity command from the work implement frame of reference to a cylinder frame of reference and responsively generating a plurality of desired cylinder velocities; and determining the plurality of desired cylinder positions from the plurality of desired cylinder velocities.

7. A method, as set forth in claim 6, wherein comparing the plurality of desired cylinder positions to allowable cylinder positions includes the steps of:

comparing the plurality of desired cylinder velocities to allowable cylinder velocities; and determining the allowable cylinder positions as a function of the allowable cylinder velocities.

8. A method for controllably moving a work implement attached to a work machine, the work implement being controllably moved by a plurality of hydraulic cylinders, including the steps of:

inputting a velocity command in a work implement frame of reference;

transforming the velocity command from the work implement frame of reference to a resolver frame of reference and responsively generating a plurality of desired resolver velocities;

comparing the plurality of desired resolver velocities to allowable resolver velocities, the allowable resolver velocities being a function of a combination of the plurality of desired resolver velocities;

determining a plurality of desired resolver positions from the plurality of desired resolver velocities in response to the desired resolver velocities being within limits of the allowable resolver velocities;

determining a plurality of desired cylinder positions as a function of the plurality of desired resolver positions;

controllably moving the work implement to a desired work implement position as a function of the desired cylinder positions; and controllably stopping the movement of the work implement in response to at least one desired resolver velocity being at a limit of a corresponding at least one allowable resolver velocity.

9. A method for controllably moving a work implement attached to a work machine, the work implement being controllably moved by a plurality of independently controlled, kinematically coupled hydraulic cylinders, including the steps of:

inputting a velocity command in a work implement frame of reference;

transforming the velocity command from the work implement frame of reference to a cylinder frame of reference and responsively generating a plurality of desired cylinder velocities;

comparing the plurality of desired cylinder velocities to allowable cylinder velocities, each allowable cylinder velocity being an independent function of a combination of the plurality of desired cylinder velocities;

determining a plurality of desired cylinder positions from the plurality of desired cylinder velocities in response to the desired cylinder velocities being within limits of the allowable cylinder velocities;

controllably moving the work implement to a desired work implement position as a function of the desired cylinder positions; and controllably stopping the movement of the work implement in response to at least one desired cylinder velocity being at a limit of a corresponding at least one allowable cylinder velocity.

* * * * *